US009878531B2

(12) United States Patent
Ballentine et al.

(10) Patent No.: US 9,878,531 B2
(45) Date of Patent: Jan. 30, 2018

(54) REIMAGEABLE AND REUSABLE PRINTING SLEEVE FOR A VARIABLE CUTOFF PRINTING PRESS

(71) Applicant: GOSS INTERNATIONAL AMERICAS, INC., Durham, NH (US)

(72) Inventors: Parris Robert Ballentine, Dover, NH (US); James Brian Vrotacoe, Barrington, NH (US); Mehmet Oktay Kaya, Hampton, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 14/565,067

(22) Filed: Dec. 9, 2014

(65) Prior Publication Data

US 2015/0174890 A1 Jun. 25, 2015

Related U.S. Application Data

(60) Provisional application No. 61/918,052, filed on Dec. 19, 2013.

(51) Int. Cl.

| | |
|---|---|
| ***B41N 1/00*** | (2006.01) |
| ***B41F 13/193*** | (2006.01) |
| ***B41C 1/10*** | (2006.01) |
| ***B41C 1/18*** | (2006.01) |
| *B41N 1/20* | (2006.01) |
| *B41N 3/00* | (2006.01) |

(52) U.S. Cl.
CPC ..... *B41F 13/193* (2013.01); *B41C 1/1008* (2013.01); *B41C 1/182* (2013.01); *B41C 1/1016* (2013.01); *B41N 1/20* (2013.01); *B41N 3/00* (2013.01)

(58) Field of Classification Search
CPC ..... B41C 1/1033; B41C 1/10; B41C 1/1066
See application file for complete search history.

(56) References Cited

U.S. PATENT DOCUMENTS

| | | | |
|---|---|---|---|
| 5,206,102 | A | 4/1993 | Tench |
| 5,379,693 | A | 1/1995 | Hoffmann et al. |
| 5,440,987 | A | 8/1995 | Williams et al. |

(Continued)

FOREIGN PATENT DOCUMENTS

| | | |
|---|---|---|
| EP | 1118471 | 7/2001 |
| EP | 1188579 A1 | 3/2002 |

(Continued)

*Primary Examiner* — Matthew G Marini
(74) *Attorney, Agent, or Firm* — Davidson, Davidson & Kappel, LLC

(57) ABSTRACT

A method of forming printing sleeve for mounting on a cylinder in a printing press is provided. The method includes providing a permanent hydrophilic tubular layer on a tubular base; selectively providing a first temporary hydrophobic layer on the hydrophilic tubular layer to form a first imaged printing sleeve, the temporary hydrophobic layer forming a first image; printing, by the first imaged printing sleeve, a first print job including the first image on a substrate; and removing the first temporary hydrophobic layer from the permanent hydrophilic layer such that the permanent hydrophilic layer remains intact on the tubular base. A lithographic printing sleeve for a printing press is also provided.

14 Claims, 4 Drawing Sheets

(56) References Cited

U.S. PATENT DOCUMENTS

| | | | | |
|---|---|---|---|---|
| 5,634,403 | A * | 6/1997 | Williams | B41C 1/1033 101/454 |
| 5,816,161 | A | 10/1998 | Nüssel et al. | |
| 6,190,828 | B1 | 2/2001 | Verschueren et al. | |
| 6,298,780 | B1 * | 10/2001 | Ben-Horin | B41C 1/1008 101/457 |
| 6,394,943 | B1 * | 5/2002 | Cormier | B41F 27/105 101/375 |
| 6,424,366 | B1 | 7/2002 | Probian et al. | |
| 6,779,449 | B1 | 8/2004 | Hoffmann et al. | |
| 2001/0008104 | A1 | 7/2001 | Verschueren et al. | |
| 2002/0106585 | A1 | 8/2002 | Verschueren et al. | |
| 2004/0118308 | A1 * | 6/2004 | Ohigashi | B41C 1/1066 101/459 |
| 2012/0312181 | A1 * | 12/2012 | Doucet | B41F 27/105 101/375 |

FOREIGN PATENT DOCUMENTS

| | | |
|---|---|---|
| EP | 1208972 | 5/2002 |
| EP | 1232877 | 8/2002 |
| EP | 1495877 A1 | 1/2005 |
| EP | 2420382 A1 * | 2/2012 |

* cited by examiner

REIMAGEABLE AND REUSABLE PRINTING SLEEVE FOR A VARIABLE CUTOFF PRINTING PRESS

Priority is hereby claimed to U.S. Provisional Application No. 61/918,052 filed on Dec. 19, 2013, the entire disclosure of which is hereby incorporated by reference herein.

The present disclosure relates generally to printing presses and more specifically to printing sleeves of variable cutoff printing presses.

BACKGROUND

U.S. Pat. No. 5,440,987, U.S. Pat. No. 5,206,102, U.S. Pat. No. 5,816,161, U.S. Pat. No. 5,379,693; U.S. Pat. No. 6,779,449; U.S. Pat. No. 6,424,366, U.S. Pat. No. 6,190,828, EP 1188579 and EP 1495877 disclose imaging techniques.

SUMMARY OF THE INVENTION

A method of forming printing sleeve for mounting on a cylinder in a printing press is provided. The method includes providing a permanent hydrophilic tubular layer on a tubular base; selectively providing a first temporary hydrophobic layer on the hydrophilic tubular layer to form a first imaged printing sleeve, the temporary hydrophobic layer forming a first image; printing, by the first imaged printing sleeve, a first print job including the first image on a substrate; and removing the first temporary hydrophobic layer from the permanent hydrophilic layer such that the permanent hydrophilic layer remains intact on the tubular base.

A lithographic printing sleeve for a printing press is also provided. The lithographic printing sleeve includes a tubular base layer for contacting and surrounding an outer circumference of the cylinder, a permanent tubular hydrophilic layer on an outer surface of the tubular base layer and a temporary hydrophobic layer on an outer surface of the tubular hydrophilic layer.

BRIEF DESCRIPTION OF THE DRAWINGS

The present invention is described below by reference to the following drawings, in which.

DETAILED DESCRIPTION

Figure 1:
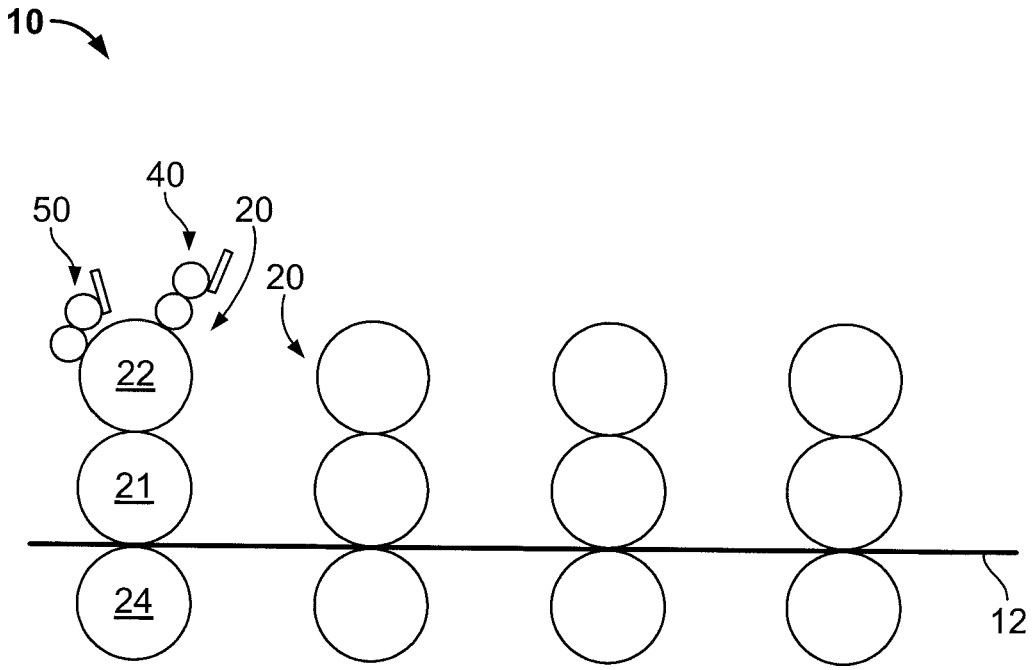
FIG. 1 shows a web offset, nonperfecting printing press in accordance with an embodiment of the present invention.

FIG. 1 shows a web offset, nonperfecting printing press in accordance with an embodiment of the present invention. Printing press 10 includes a plurality of printing units 20 printing on a web 12. Each printing unit may include a plate cylinder 22, a blanket cylinder 21 and an impression cylinder 24. Each plate cylinder 22 includes a corresponding dampening apparatus 40 and a corresponding inking apparatus 50 for supplying a dampening fountain solution and ink to plate cylinder 22. After a web 12 is printed, web 12 may be split into a plurality of ribbons, folded longitudinally and/or cut into signatures.

Printing press 10 is a variable cutoff printing press. A variable cutoff printing press as used herein refers to a printing press that can be modified between print jobs so that the printing press can print repeating images of different lengths during different print jobs. The length of the repeating images printed during a particular print job is commonly referred to as a cutoff length or a cutoff. Plate cylinders and blanket cylinders that print the repeating images for the particular print job may be said to have that cutoff length or cutoff. For example, a variable cutoff printing press can print repeating images of a first cutoff length on a web or other substrate during a first print job and then can print repeating images of a second cutoff length that varies from the first cutoff length on a web or other substrate during a subsequent second print job. The first print job is printed using a first printing plate and a first printing blanket each having an outer circumference of a length corresponding to the first cutoff length. After the first print job and before the second print job, the first printing plate and the first printing blanket, which are in the form of gapless tubular sleeves, are removed from the printing unit and replaced with a second printing plate and a second printing blanket, which are also in the form of gapless tubular sleeves, that each have outer circumferences of a length corresponding to the second cutoff length.

Figure 2A:
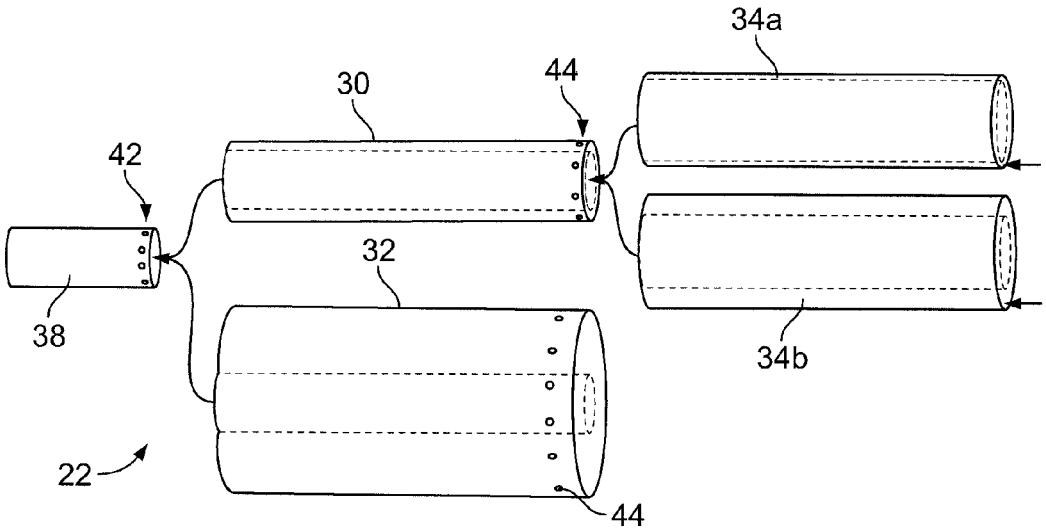
FIGS. 2*a* and 2*b* show a plate cylinder in accordance with an embodiment of the present invention.
Figure 2B:
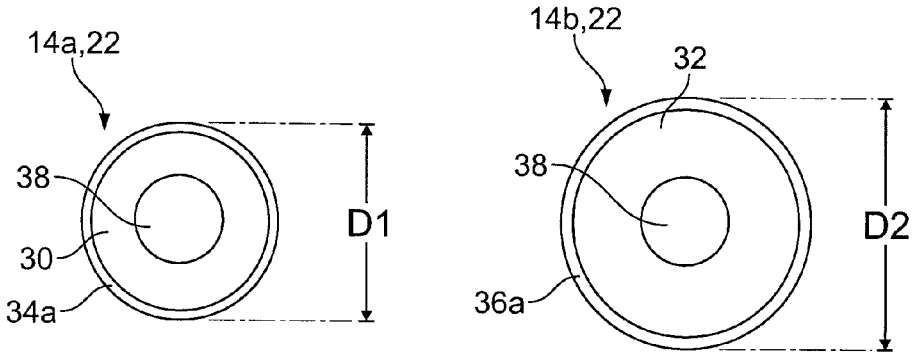

FIGS. 2*a* and 2*b* show plate cylinder 22 in accordance with an embodiment of the present invention. The cutoff length of plate cylinder 22 may be varied by varying the outer diameter thereof through the exchange of support cylinders 30, 32 and tubular printing sleeves 34*a*, 34*b*, 36*a* on a mandrel 38. Printing sleeves 34*a*, 34*b*, 36*a* are hollow tubes that are mountable onto mandrel 38 via corresponding support cylinders 30, 32. FIG. 2*a* shows mandrel 38, two different sized support cylinders—smaller support cylinder 30 and larger support cylinder 32—and two different sized printing sleeves—a smaller cutoff printing sleeve 34*a* and a larger cutoff printing sleeve 34*b*—that may be mounted on smaller support cylinder 30. FIG. 2*b* shows a smaller cutoff arrangement 14*a*, which includes mandrel 38, support cylinder 30 and printing sleeve 34*a*, having a diameter D1 and a larger cutoff arrangement 14*b*, which includes mandrel 38, support cylinder 32 and printing sleeve 36*a*, having a diameter D2. The support cylinders and printing sleeves shown are merely exemplary, as support cylinders and printing sleeves of a variety of thicknesses may be used with mandrel 38.

Mandrel 38 may be held at an axial end by a support, one of support cylinders 30, 32 may be slid over the outer surface of mandrel 38 and the corresponding tubular printing sleeve 34*a*, 34*b*, 36*a* may be slid over the corresponding support cylinder 30, 32. For example, during a cutoff change, the support holding the axial end of mandrel 38 is uncoupled from and swung away from mandrel 38. A printing sleeve 34*a*, 34*b*, 36*a* mounted on mandrel 38 via the corresponding support cylinder 30, 32 is then slid off of the corresponding support cylinder 30, 32. If, for example, support cylinder 30 and printing sleeve 34*a* are mounted on mandrel 38 and a press operator wants to switch to printing sleeve 34*b*, support cylinder 30 is kept on mandrel 38 and the cutoff change may be accomplished by sliding printing sleeve 34*a* off of support cylinder 30 and sliding printing sleeve 34*b* onto support cylinder 30. If, for example, support cylinder 30 and printing sleeve 34*a* are mounted on mandrel 38 and a press operator wants to switch to printing sleeve 36*a*, printing sleeve 34*a* and support cylinder 30 are removed from mandrel 38 and the cutoff change may be accomplished by sliding support cylinder 32 onto mandrel 38 and and sliding printing sleeve 36*a* onto support cylinder 32.

Mandrel 38 may include holes 42 formed in the outer surface thereof at the axial end of mandrel 38 that support cylinders 30, 32 are slid onto so pressurized air may be supplied internally to mandrel 38 and flow out of holes 42 to pneumatically mount support cylinders 30, 32 on and remove support cylinders 30, 32 from mandrel 38. Similarly, support cylinders 30, 32 may each include holes 44 formed in the outer surface thereof at the axial end of thereof, which align with holes 42, so pressurized air may be supplied internally to mandrel 38 and flow out of holes 44 to pneumatically mount printing sleeves 34*a*, 34*b*, 36*a* on and remove printing sleeves 34*a*, 34*b*, 36*a* from the corresponding support cylinders 30, 32. The air pressure (e.g., 70 to 160 psi) supplied to the outer surface of mandrel 38 or support cylinders 30, 32 radially expands the corresponding support cylinders 30, 32 or sleeve 34*a*, 34*b*, 36*b* being mounted or removed allowing for the sliding. The sleeves are secured on the support cylinders by a clamping force, through an interference fit between the sleeve and cylinder. This clamping pressure keeps the printing sleeve's position fixed while on the cylinder. The circumferential and lateral positions of the printing sleeve are dictated by a registration system, such as a positioning pin and slot. For the unit to unit register, a similar positioning system is used on all of the printing units. After a sleeve is slid onto a respective mandrel, the supply of air to the mandrel is stopped and the sleeve is snugly held in place on the mandrel.

Infinite repeats, for example from 406.4 mm (16") to 1400 mm (55.12"), are achieved by changing the outer diameter and thickness of the printing sleeve. This infinite repeat range is divided into 15 to 30 discretely sized cylinders, for example. All of the support cylinders have a common inner diameter, allowing for them to be mounted on the same mandrel in the printing press. For each of the support cylinder sizes, the inner diameter of the printing sleeves are kept constant and the wall thicknesses are varied to reach the desired image repeat. Due to the large variety of diameters and wall thicknesses, the printing sleeve is made out of wound or extruded materials such as fiberglass, carbon fiber, polyester, polyurethane, epoxy, or other composite materials.

The printing sleeves, for example sleeves 34*a*, 34*b*, 36*a*, are each made into a lithographic printing sleeves for use on a printing unit by first starting with a hydrophilic surface and adding hydrophobic material onto the surface. As in traditional lithography, the hydrophilic material is the non-image area (attracts fountain solution), while the hydrophobic material is the image area, which repels fountain solution and attracts ink. For embodiments of the present invention, the hydrophobic material is applied over the hydrophilic material.

Figure 3A:
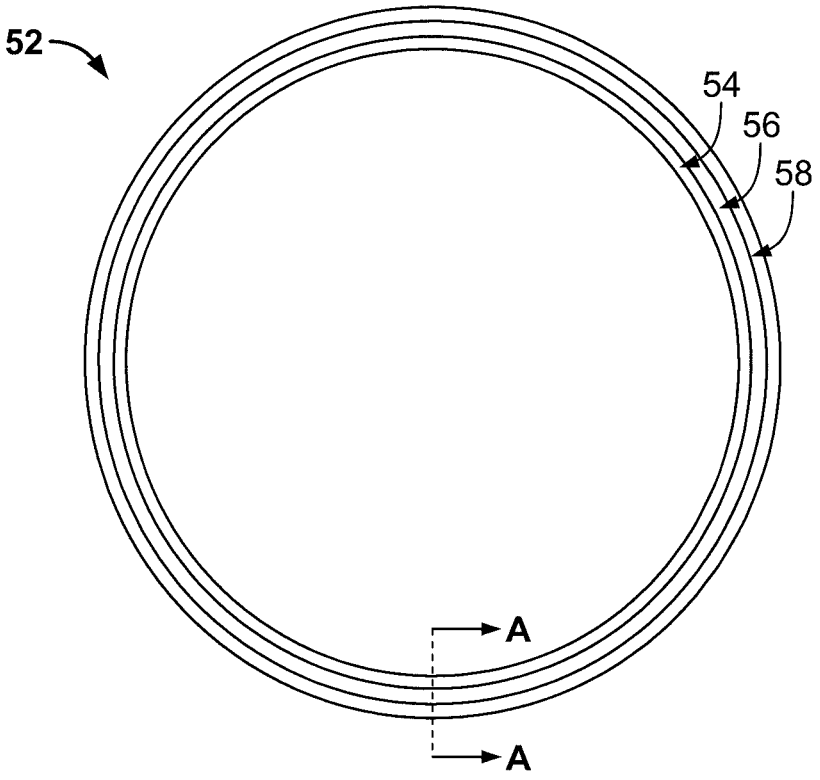
FIG. 3*a* shows a tubular printing sleeve in accordance with an embodiment of the present invention.

FIG. 3*a* shows a tubular printing sleeve 52 in accordance with an embodiment of the present invention. Tubular printing sleeve 52 includes a tubular base layer 54 for contacting and surrounding an outer circumference of a support cylinder (e.g., one of cylinders 30, 32), a permanent tubular hydrophilic layer 56 on an outer surface of the tubular base layer 54 and a temporary hydrophobic layer 58 on an outer surface of the tubular hydrophilic layer 56. While permanent tubular hydrophilic layer 56 covers the entire outer surface of base layer 54, temporary hydrophobic layer 58 covers only portions of hydrophilic layer 56, as dictated by the image to be printed by printing sleeve 52.

Figure 3B:
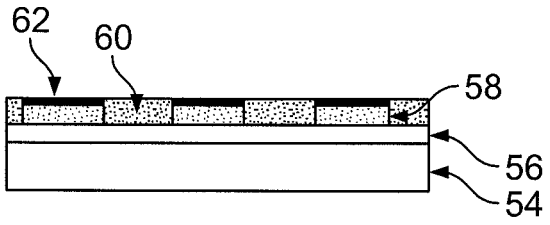
FIG. 3*b* shows a view of a cross-section of a portion of the printing sleeve along A-A in FIG. 3*a;*

FIG. 3*b* shows a view of a cross-section of a portion of printing sleeve 52 along A-A in FIG. 3*a*, illustrating an example of how the temporary hydrophobic layer 58 defines the image area and the exposed portions of permanent hydrophilic layer 56, i.e., the portions of permanent hydrophilic layer 56 that are not covered by temporary hydrophobic layer 58, represent the non-image areas. As shown in FIG. 3*b*, fountain solution 60 is drawn to the non-image areas formed on the outer surface of hydrophilic layer 56 and ink 62 is drawn to the image areas formed on the outer surface of hydrophobic layer 58.

Figure 3C:
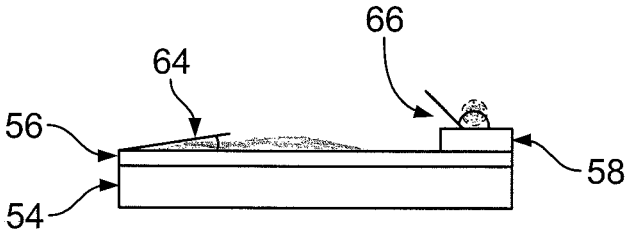
FIG. 3*c* shows a view of a cross-section of another portion of printing sleeve along A-A in FIG. 3*a;*

FIG. 3*c* shows a view of a cross-section of another portion of printing sleeve 52 along A-A in FIG. 3*a*, illustrating an example of hydrophilic and hydrophobic contact angles. The surface energy of the hydrophilic material of hydrophilic layer 56 is greater than the surface tension of the fountain solution to cause the fountain solution to be attracted to the non-image area. This difference creates a low contact angle 64 between the fountain solution and non-image area, causing the fountain solution to "wet out." The layer of fountain solution prevents ink from transferring in designated areas, therefore creating the non-image area. To create the hydrophilic surface of hydrophilic layer 56, metals, oxides or ceramics with high surface energies such as chromium, silver, aluminum oxide, titanium oxide, nickel oxide, or silicon dioxide may be used as the hydrophilic material for forming hydrophilic layer 56. The hydrophilic properties of these materials can be increased by changing the surface geometry through methods such as grinding, polishing, electro-graining, or anodizing.

The surface energy of the hydrophobic material of hydrophobic layer 58 is lower than the surface tension of the fountain solution. This difference creates a high contact angle 66 between the fountain solution and the image area, causing the fountain solution to repel from these areas. Since these low surface energy areas are dry and free of fountain solution, ink is attracted and transferred further down in the printing process. The hydrophobic surface may be created from low surface energy materials such as epoxies or synthetic polymers. Multiple materials and layers may be required to complete the image area, such as a primer to promote adhesion or a top coating for chemical resistance.

For printing sleeve 52 to be continuous, the hydrophobic (image areas) and hydrophilic (non-image areas) materials exist in full circumference, i.e. without a gap, seam. Printing sleeve 52 is reusable and reimageable because the hydrophilic (non-image) area formed by hydrophilic layer 56 is permanent (i.e. hard and durable) and the hydrophobic (image) area formed hydrophobic layer 58 is removed and reapplied between print jobs.

Figure 4A:
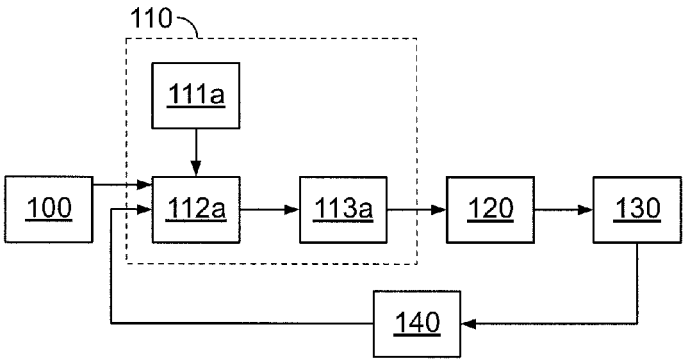
FIGS. 4*a* to 4*c* show methods of forming an imaged printing sleeve in accordance with different embodiments of the present invention.
Figure 4B:
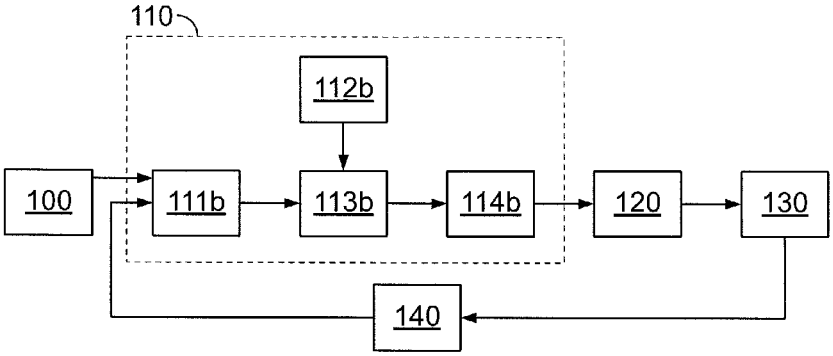
Figure 4C:
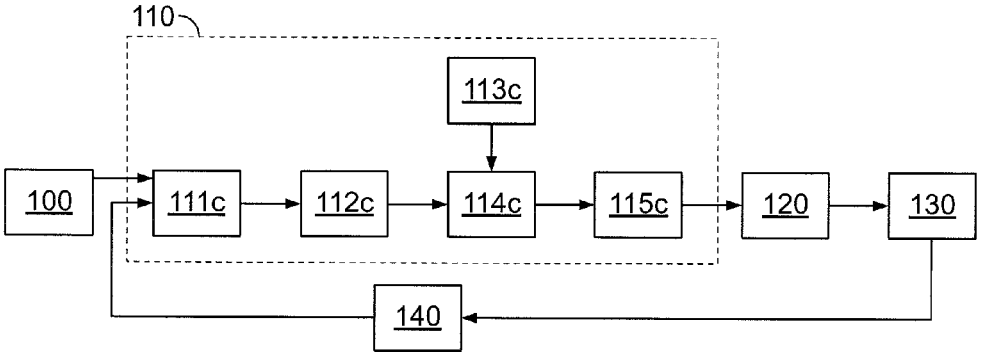

FIGS. 4*a* to 4*c* show methods of forming an imaged printing sleeve in accordance with different embodiments of the present invention. All of these embodiments include a step 100 of providing a permanent hydrophilic tubular layer on a tubular base. The permanent hydrophilic tubular layer may be provided on the tubular base hydrophilic material by forming a hydrophilic material on the tubular base through metal deposition processes such as thermal spraying, vapor deposition, or electroplating. These embodiments then each use different techniques for a step 110 of selectively providing a first temporary hydrophobic layer on the hydrophilic tubular layer at desired image area locations to form a first imaged printing sleeve. The temporary hydrophobic layer forms a first image on the first imaged printing sleeve. The hydrophobic material is applied onto the permanent hydrophilic layer through thin film coating techniques such as, spray coating, spin coating, dip coating, or ink jetting.

Creating and imaging the hydrophobic material image area can be performed by different techniques, all of which may be performed in the printing press (FIG. 1) or out of the printing press in a stand alone unit.

The embodiments in FIGS. 4*a* to 4*c* may then include a step 120 of pretreating the first imaged printing sleeve. The fully imaged printing sleeve is made press ready by going through a final cleaning process. The sleeve is first soaked in a degreasing solution to remove all containments and oils. After degreasing, the chemical solution and remaining containments are rinsed in a washing step. A water soluble layer such as gum Arabic is then applied over the non-image and image areas of the sleeve to protect the sleeve from damaging factors such as oxidation and light exposure. After drying, the sleeve is ready for printing and can be mounted on press. The embodiments in FIGS. 4*a* to 4*c* then include a step 130 of printing, by the first imaged printing sleeve, a first print job including the first image on a substrate.

After the first print job is completed, the embodiments in FIGS. 4*a* to 4*c* include a step 140 of removing the first temporary hydrophobic layer from the permanent hydrophilic layer such that the permanent hydrophilic layer remains intact on the tubular base. The hydrophobic material may be removed by a mechanical operation such as grit blasting, brushing, or scraping. The temporary hydrophobic layer may also be broken down and removed by a chemical wash operation. A combination of chemical and mechanical operations may also be used.

After all of the image area is removed, the hydrophilic surface may be rinsed and the embodiments of FIGS. 4*a* to 4*c* may then return to step 110 to selectively provide a second temporary hydrophobic layer on the hydrophilic tubular layer to form a second imaged printing sleeve, and proceed through steps 120, 130, 140 again. This loop may be repeated as needed by the operator of the printing press. If an additional print job needs to be printed that has a cutoff length greater than is possible by the printing sleeve being reimaged, a second sleeve including a tubular base and a permanent hydrophilic tubular layer having a different outer diameter may be provided and processed through steps 110, 120, 130, 140. Changing the cutoff length may include providing a support cylinder of a different outer diameter than the support cylinder supporting the first imaged printing sleeve. The cutoff may be changed selectively providing a second temporary hydrophobic layer on a second permanent hydrophilic tubular layer, which forms a second image different from the first image, of a second printing sleeve to form a second imaged printing sleeve having a different cutoff length than the first imaged printing sleeve. The second imaged printing sleeve may be used in the printing press to print a second print job including the second image on a substrate. After the second print job is completed, the second temporary hydrophobic layer may be removed from the second permanent hydrophilic layer such that the second permanent hydrophilic layer remains intact on the tubular base. The second sleeve may then be reimaged in step 110 and steps 120, 130, 140 may be repeated.

In the embodiment of FIG. 4*a*, step 110 includes a first substep 111*a* of providing a digital image to a controller of an ink depositing device, for example an inkjet head. Step 110 also includes a substep 112*a* of selectively depositing, for example ink jetting, hydrophobic material onto the hydrophilic tubular layer. A substep 113*a* of curing the hydrophobic material is then performed to form the first image. The hydrophobic material may be cured by a curing unit such as an infrared (830 nm) laser or UV light which is controlled by a controller such as a computer processor. The curing step chemically bonds the hydrophobic material to itself and to the hydrophilic layer producing a lithographic imaged printing sleeve.

In the embodiment of FIG. 4*b*, step 110 includes a first substep 111*b* of coating an entirety of the hydrophilic tubular layer with hydrophobic material. The hydrophilic layer may be completely coated with the hydrophobic material using thin film coating techniques such as spin coating or spray coating. Step 110 also includes a substep 112*b* of providing a digital image to a controller of a curing unit and a substep 113*b* of selectively curing, via the curing unit, the hydrophobic material at desired image area locations. The curing step hardens the hydrophobic material and bonds it to the hydrophilic layer. A substep 114*b* of removing the uncured hydrophobic material is then performed. The remaining uncured hydrophobic material may be removed using a mechanical and/or chemical cleaning process. This cleaning reveals the permanent hydrophilic material below to form the lithographic imaged printing sleeve.

In the embodiment of FIG. 4*c*, step 110 includes a first substep 111*c* of coating an entirety of the hydrophilic tubular layer with hydrophobic material in the same manner as substep 111*b*. Step 110 also includes a substep 112*c* of curing, via a curing unit, the hydrophobic material. The entire hydrophobic material is cured and a larger, less precise curing unit than used in substep 113*b* may be used. A substep 113*c* of providing a digital image to a controller of an ablation or coating softening source is then performed, followed by a substep 114*c* of selectively breaking down parts of the hydrophobic material and a substep 115*c* of removing the broken down hydrophobic material to form the first image. The parts of hydrophobic material may be broken down by ablation, to chemically and/or thermally break down the hydrophobic material in the non-desired image areas. The broken down hydrophobic material may be removed by a cleaning process that expose the hydrophilic area below the broken down hydrophobic material.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method of forming printing sleeve for mounting on a cylinder and printing in a printing press comprising:

providing a permanent hydrophilic tubular layer on a pneumatically expandable tubular base;

selectively providing a first temporary hydrophobic layer on the hydrophilic tubular layer to form a first imaged printing sleeve, the temporary hydrophobic layer forming a first image, the first imaged printing sleeve including tubular base, the permanent hydrophilic tubular layer and the temporary hydrophobic layer;

sliding the first imaged printing sleeve over the cylinder via pneumatic expansion of the tubular base;

securing the tubular base on the cylinder with an interference fit;

printing, by the first imaged printing sleeve, a first print job including the first image on a substrate; and removing the first temporary hydrophobic layer from the permanent hydrophilic layer such that the permanent hydrophilic layer remains intact on the tubular base.

2. The method as recited in claim 1 wherein the selectively providing the first temporary hydrophobic layer on the hydrophilic tubular layer to form the first imaged printing sleeve comprises:

selectively depositing hydrophobic material onto the hydrophilic tubular layer; and curing the hydrophobic material to form the first image.

3. The method as recited in claim 1 further comprising selectively providing a second temporary hydrophobic layer on the hydrophilic tubular layer to form a second imaged printing sleeve, the temporary hydrophobic layer forming a second image different from the first image, the second imaged printing sleeve including tubular base, the permanent hydrophilic tubular layer and the temporary hydrophobic layer;

printing, by the second imaged printing sleeve, a second print job including the second image on a substrate; and removing the second temporary hydrophobic layer from the permanent hydrophilic layer such that the permanent hydrophilic layer remains intact on the tubular base.

4. The method as recited in claim 1 further comprising selectively providing a second temporary hydrophobic layer on a second permanent hydrophilic tubular layer of a second printing sleeve to form a second imaged printing sleeve, the second temporary hydrophobic layer forming a second image different from the first image, the second imaged printing sleeve having a different cutoff length than the first imaged printing sleeve;

printing, by the second imaged printing sleeve, a second print job including the second image on a substrate; and removing the second temporary hydrophobic layer from the second permanent hydrophilic layer such that the second permanent hydrophilic layer remains intact on the tubular base.

5. The method as recited in claim 1 further comprising, before printing the first print job, providing a degreasing solution to the first imaged printing sleeve.

6. The method as recited in claim 1 further comprising, before printing the first print job, applying a water soluble layer onto image and non-image areas of the first imaged printing sleeve.

7. The method as recited in claim 1 wherein the removing the first temporary hydrophobic layer from the permanent hydrophilic layer includes mechanically removing the first temporary hydrophobic layer.

8. The method as recited in claim 7 wherein the mechanically removing the first temporary hydrophobic layer includes grit blasting, brushing or scraping the first temporary hydrophobic layer.

9. The method as recited in claim 1 wherein the removing the first temporary hydrophobic layer from the permanent hydrophilic layer includes chemically removing the first temporary hydrophobic layer.

10. The method as recited in claim 9 wherein the chemically removing the first temporary hydrophobic layer includes breaking down and removing the first temporary hydrophobic layer by a chemical wash.

11. The method as recited in claim 1 wherein the permanent hydrophilic layer and the temporary hydrophobic layer are continuous on the first imaged printing sleeve such that the permanent hydrophilic layer and the temporary hydrophobic layer exist in full circumference on the first imaged printing sleeve.

12. The method as recited in claim 1 wherein the permanent hydrophilic tubular layer is made from a high surface area energy hydrophilic material selected from the group consisting of titanium oxide, nickel oxide, or silicon dioxide, and wherein the temporary hydrophobic layer is made from a low surface area energy material consisting of an epoxy or a synthetic polymer.

13. The method as recited in claim 1 wherein the providing step further includes increasing the hydrophilicity by changing the surface geometry of the hydrophilic material by grinding, polishing, or electro-graining the hydrophilic material.

14. The method as recited in claim 1 wherein the selectively providing step further includes applying the temporary hydrophobic layer in multiple layers.

* * * * *